United States Patent [19]

Rieger

[11] Patent Number: 4,744,164

[45] Date of Patent: May 17, 1988

[54] CARTRIDGE FEEDING DEVICE FOR REPEATING RIFLE

[75] Inventor: Benedikt Rieger, Altenmünster-Hegnenbach, Fed. Rep. of Germany

[73] Assignee: Dynamit Nobel Aktiengesellschaft, Troisdorf, Fed. Rep. of Germany

[21] Appl. No.: 934,541

[22] Filed: Nov. 24, 1986

[30] Foreign Application Priority Data

Nov. 23, 1985 [DE] Fed. Rep. of Germany ..... 3541430

[51] Int. Cl.[4] ..... F41C 13/00

[52] U.S. Cl. ..... 42/18

[58] Field of Search ..... 42/16–18, 42/21, 22, 10, 11, 50; 89/33.1, 161

[56] References Cited

U.S. PATENT DOCUMENTS

| | | | |
|---|---|---|---|
| 2,369,244 | 2/1945 | Lowe | 42/17 |
| 3,570,366 | 3/1971 | Nickel | 42/17 |
| 3,667,147 | 6/1972 | Goldin et al. | 42/15 |
| 3,736,839 | 6/1973 | Childers | 89/161 X |
| 4,527,459 | 7/1985 | Childers | 89/161 |
| 4,562,659 | 1/1986 | Neta | 42/75.03 |

FOREIGN PATENT DOCUMENTS 2757504 7/1978 Fed. Rep. of Germany .

*Primary Examiner*—Ted L. Parr

*Attorney, Agent, or Firm*—Antonelli, Terry & Wands

[57] ABSTRACT

In a cartridge feeding device for a repeating rifle, a magazine well is provided in the breech casing in front of the rear barrel end underneath the rear end. Toward the rear, a guide housing is arranged behind the magazine well, this housing has an opening at the top in a zone behind a breech head of the rifle and, in a rearward half of this opening, two mutually opposed holding lips, the mutual spacing (a) of the latter being somewhat smaller than the case diameter of the cartridge. A loading plate is pivotably mounted in the guide housing, this plate being pivotable upwardly under spring action. The magazine box exhibits at the top an opening extending over its entire length and, in the region of this opening, two mutually opposed magazine lips. A slide is provided which is connected with the displaceable guide strips of the breech mechanism and extends transversely to the barrel axis (A); this slide is arranged at the level of the uppermost cartridge, and is located, in the locking position of the breech mechanism, in front of the projectile tip of the uppermost cartridge, and contacts, upon a backward movement of the breech mechanism, the projectile tip of the uppermost cartridge, pushing the latter rearwardly out of the magazine box into the guide housing.

16 Claims, 2 Drawing Sheets

CARTRIDGE FEEDING DEVICE FOR REPEATING RIFLE

The invention relates to a cartridge feeding device for a repeating rifle, equipped with a barrel, breech casing, a magazine well provided in front of a rearward end of the barrel end and underneath the latter, for receiving a magazine box which exhibits a withdrawal opening in its rear wall, two guide strips being mounted at the breech casing to be displaceable in the direction of the barrel axis and carrying a breech mechanism, and a loading plate pivotable about a pivot axis arranged transversely to the barrel axis below a moving zone of the breech mechanism; the loading plate comprising a supporting surface for the cartridge sleeve and being pivotable upwardly into a loading position under the effect of a spring.

In a conventional cartridge feeding device for a repeating rifle (Austrian Pat. No. 365,336 or also DOS No. 1,728,124), the magazine is located in front of the rear end of the barrel or, respectively in front of the breech head arranged at the rear end of the barrel so that the rear barrel end comes to lie as far backwards as possible and thus the total length of the repeating rifle is reduced. This, then presupposes a special cartridge feeding device which, during the repeating process, extracts a cartridge rearwardly from the magazine box and swings the cartridge, as soon as the tip of the projectile is located behind the breech head (casing head), upwardly so that the projectile tip comes to lie in front of the rear opening of the breech head. During the forward motion of the breech mechanism, the cartridge then slides into the cartridge chamber.

The conventional cartridge feeding device, however, consists of a plurality of individual components which, for the most part, are movable. An extractor part is pivotably connected with guide strips, this part having two spring-loaded arms carrying extractor hooks at their front ends. By means of this extractor part, the extractor hooks of which engage into an extractor groove of the cartridge case, the cartridge is pulled toward the rear out of the magazine during the backward movement of the breech mechanism and is transferred to a loading plate. The movement of the loading plate is controlled by several intermediate members. During the upward pivoting of the loading plate, the extractor part must still retain the cartridge cases. However, since this retaining action only takes place at the extractor groove provided at the case bottom, the retaining effect is imperfect. Thus, trouble is frequently encountered during the loading operation. Disturbances during loading, which can also lead to damaging of the sensitive tip of the projectile, are furthermore encountered due to the fact that the cartridges can exhibit differing lengths. Since the cartridge is seized by the extractor hooks at the extractor groove, the cartridge bottom arrives always at the same location during the loading process. Thereby, the projectile tip, prior to being inserted in the opening of the breech head, will have in each case a different spacing depending on the total length of the cartridge. Since the cartridge axis during insertion in the breech head is inclined obliquely with respect to the barrel axis, trouble can be encountered when inserting the tip of the projectile in the breech head. Additional sources of trouble are the sensitive extractor hooks. Furthermore, several movable parts are required for controlling the pivoting motion of the loading plate; on account of the large number of individual parts; the known cartridge feeding device is expensive to manufacture and to assemble, and is also prone to disturbances. Another disadvantage resides in that in all cases only one row of cartridges can be arranged in superposition in the magazine box inasmuch as the extractor part can seize a cartridge only at the same location.

Repeating rifles are also known wherein the magazine well is arranged behind the breech head. This, however, results in a larger total length of the firearm. In such repeating rifles (for example Mauser rifle M98), magazine boxes can be utilized wherein the cartridges are accommodated in two rows side-by-side in a zigzag arrangement. This affords the advantage that the magazine well, with the same structural height, can receive double the number of cartridges as compared with a magazine box with only one row of cartridges.

The invention is based on the object of improving the cartridge feeding device for a repeating rifle of the type heretofore described so that it has less movable individual parts and thus is less expensive to manufacture and to assemble; so that it operates extensively trouble-free. Furthermore the device is optionally also usable in case of magazine boxes wherein the cartridges are received in a double row arrangement in a zigzag pattern.

This object has been attained according to the invention by providing that the magazine well is followed toward the rear by a guide housing exhibiting, in the zone behind the breech head, at the opening extending over one cartridge length and, in the rearward half of this opening, two mutually opposed holding lips in the manner of magazine lips, the mutual space of these lips being somewhat smaller than the case diameter; that the loading plate is mounted in the guide housing to be pivotable about the pivot axis provided at its front end and arranged in the proximity of the magazine well; that the magazine box exhibits at the top an opening extending over its entire length and, in the zone of the opening, two mutually opposed magazine lips; that a slide is provided in the upper zone of the magazine well, this slide being connected to the guide strips and extending transversely to the barrel axis, which slide is located at the level of the uppermost cartridge, is disposed, in the locking position of the breech mechanism, in front of the projectile tip of the uppermost cartridge, and comes into contact, during the backward movement of the breech mechanism, with the projectile tip of the uppermost cartridge, pushing the cartridge rearwardly out of the magazine box into the guide well.

In the novel cartridge feeding device of this invention, the number of movable parts has been substantially reduced. These include basically a pivotable loading plate present as a movable part, for the slide proper is fixedly connected with the guide strips. On account of the substantial reduction of the number of movable parts, the structure is simpler, the manufacture is more economical, and, in particular, the novel cartridge feeding device is less prone to disturbances. This is due, inter alia, also to the fact that movable extractor tools are eliminated. Since the cartridge in the novel cartridge feeding device is no longer pulled out of the magazine but rather is pushed, there is no need for coupling the cartridge with an extractor mechanism. The feature of removal by pushing furthermore has the advantage that the position of the projectile tip in front of the breech head is always the same, since this position is determined by the slide engaging the tip of the projectile. Furthermore, the cartridge case is supported and guided along a relatively large length, prior to insertion and likewise during the insertion in the breech head, by the holding lips. On account of this improved support and guidance, trouble is avoided during the loading process and damage to the projectile tip as well as to the case is prevented. Another substantial advantage of the novel cartridge feeding device also resides in that the device can likewise be used for magazine boxes with two rows of cartridges in a zigzag arrangement. It is thus possible without enlarging the magazine height to double the magazine capacity without the magazine projecting past the stock in the downward direction; this has heretofore been impossible in repeating rifles wherein the magazine is located in front of the rear barrel end.

The invention will be described in greater detail with reference to an embodiment illustrated in the accompanying drawings wherein.

Figure 1:
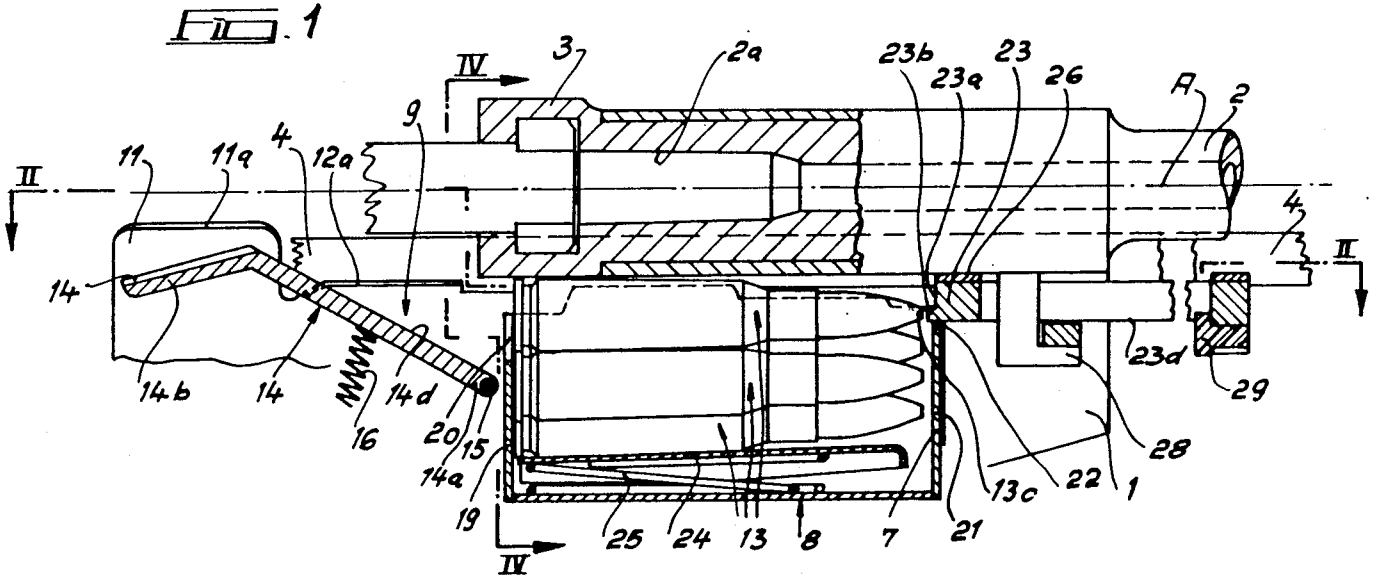
FIG. 1 is a longitudinal sectional view of the cartridge feeding device in the closed position of the breech mechanism.
Figures 3, 4, 5:
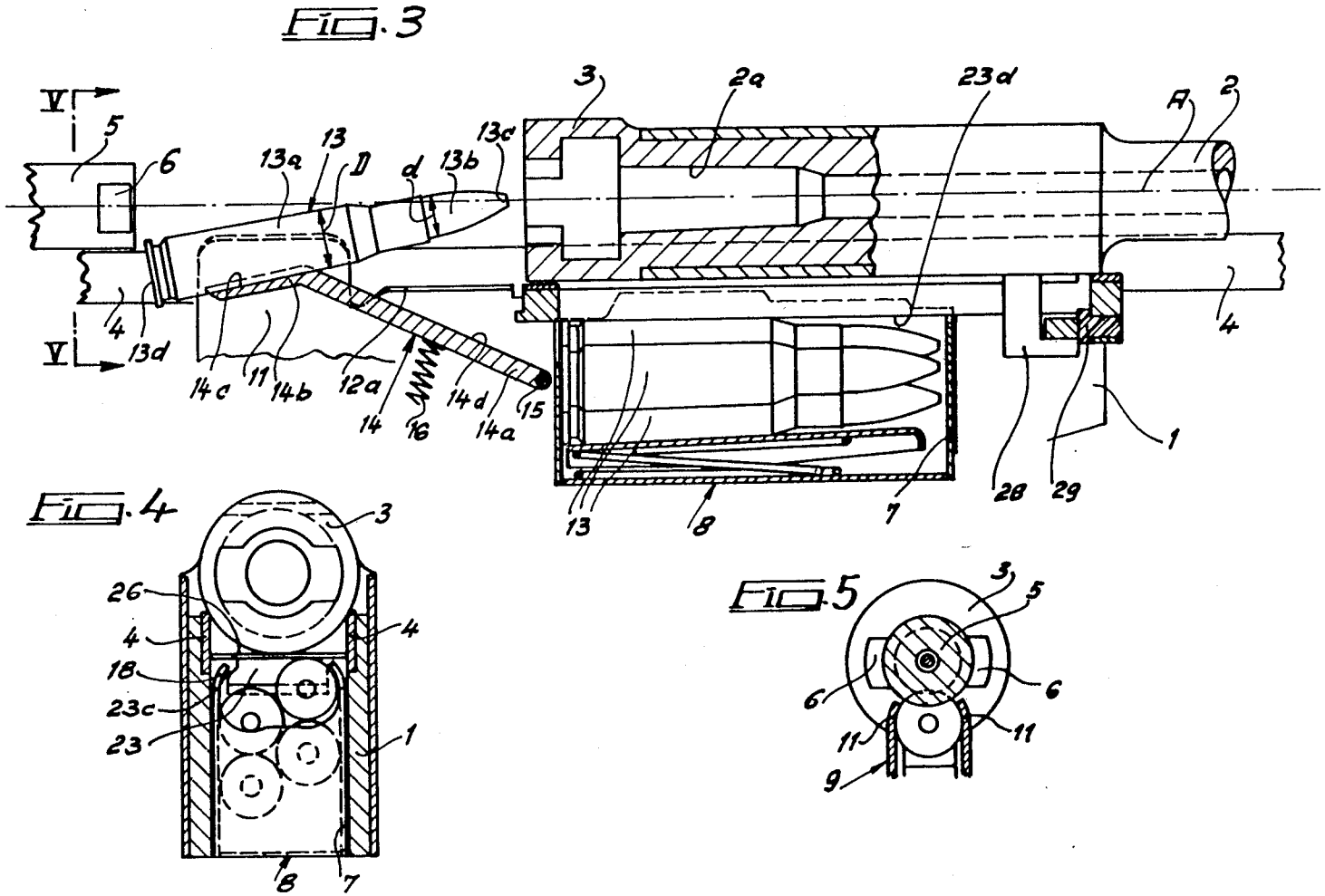
FIG. 3 shows a longitudinal sectional view with the breech mechanism in the open position.
FIG. 4 shows a cross-section taken along line IV—IV of FIG. 1.
FIG. 5 shows a cross-section taken along line V—V of FIG. 3.

As shown in FIG. 1, the breech casing 1 is connected in a conventional fashion with the stock, not shown in detail, of the repeating rifle. The barrel 2 is connected to the breech casing; this can be done, for example, in the way disclosed in greater detail in German Utility Model No. 85 17 904. The barrel 2 carries the breech head 3 at its rear end. As to the breech mechanism, which is connected with the two guide strips 4, only the bolt 5 and the locking tabs 6 are illustrated in FIG. 3. The guide strips 4 of the breech mechanism, designed as a so-called "compact breech", are displaceably guided in the direction of the barrel axis A in the breech casing 1. The breech casing 1 comprises a magazine well 7 in which can be inserted a magazine box 8 from the bottom. The magazine box 8 terminates flush with the underside of the breech casing 1 in the illustrated embodiment. However, the magazine box can also project beyond the underside of the breech casing if the magazine box is intended for accommodating a relatively large number of cartridges.

Figure 2:
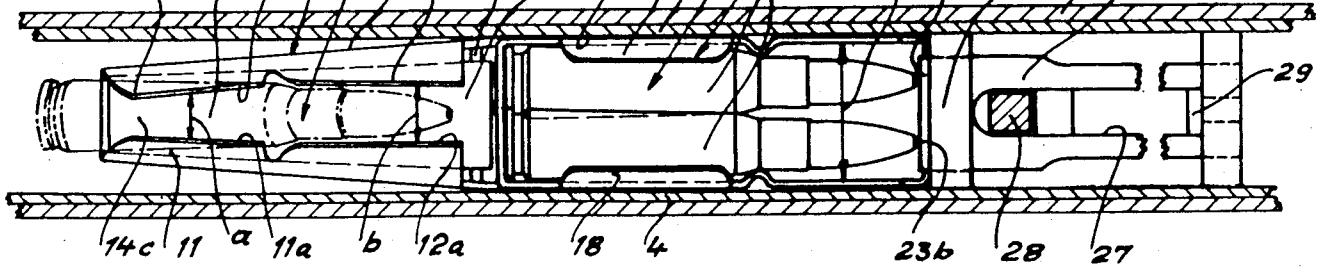
FIG. 2 shows a cross-section taken along line II—II of FIG. 1.

A guide housing 9 adjoins the magazine well 7 toward the rear of the well. This guide housing 9 has an opening 10 in a zone behind the breech head 3 at the top, this opening extending over the length of one cartridge. Two holding lips 11 are provided at the rear half of the opening 10, these lips being fashioned similarly to magazine lips. The holding lips 11 are arranged in mutual opposition. As can be seen from FIG. 2, the spacing a of the upper, mutually facing rims 11*a* of the holding lips increases in a forward direction toward the breech head. The mutual spacing a of the holding lip rims 11*a* is smaller than the cartridge case diameter D (as shown in FIG. 3). In the forward half, the opening 10 is defined by the longitudinal edges 12*a* of the inwardly curved sidewalls 12 of the housing. The opening 10 has a width b in its forward half which is smaller than the case diameter D, but larger than the diameter d of the projectile 13*b* and, respectively, the case orifice. The width b of the forward portion of the opening 10 must be such that, while a cartridge 13 is pushed rearwardly, its case 13*a* cannot escape in the upward direction and is thus guided, and that, with the cartridge 13 being pushed backwards entirely, the projectile 13*b* can pass in the upward direction between the longitudinal edges 12*a*, as is illustrated by means of the dot-dash lines showing the cartridge 13 in FIG. 2.

In the guide housing 9, the loading plate 14 is mounted to be pivotable at its front end 14*a* about a pivot axis 15 arranged transversely to the barrel axis A. The pivot axis 15 is located in the proximity of the magazine well 7. The loading plate 14 carries at its rear end 14*b* a concave supporting surface 14*c* for the cartridge case 13*a*. Furthermore, a spring 16 acts on the loading plate 14, urging the plate upwardly in the direction toward the opening 10. The loading plate 14 furthermore has a guide surface 14*d* adjoining its front end 14*a*.

The magazine box 8 has an opening 17 at the top, this opening extending over the entire length of the magazine box. Two magazine lips 18 are arranged in the region of this opening 17 in the rear half of the magazine box. A removal opening 20 is provided in the rear wall 19 of the magazine box in the upper zone thereof. The front wall 21 furthermore exhibits, in the upper zone, a passage opening 22 for the slide 23 which latter will be described in detail below.

Preferably, the cartridges 13 are arranged in the magazine box 8 in zigzag pattern in a double row. For this purpose, the magazine box 8 has an inside width W which is somewhat smaller than twice the case diameter D. Also, a magazine bottom 24 is provided in the magazine box, this bottom being urged upwardly by the magazine spring 25. The respectively uppermost cartridge 13 is retained on one of the magazine lips 18. Although the opening 17 exhibits also between the magazine lips 18 a width larger than the case diameter, the cartridges cannot spontaneously exit from the magazine box 8 because the uppermost cartridge is retained, besides on the magazine lip 18, also on the cartridge located at its side, and by the cartridge lying below it.

The cartridges can, however, be inserted under pressure from above in the magazine box 8, or be removed therefrom, after the magazine box 8 has been taken out of the magazine well 7.

When using, as is the case in the illustrated embodiment, a magazine box 8 with a double row arrangement of the cartridges 13, then the guide housing 9 has an inside width at the front which corresponds to that of the magazine box. The guide housing 9 tapers toward the rear to an inside width only slightly larger than the case diameter D, as can also be observed from FIGS. 2 and 5. In case of a magazine wherein the cartridges are arranged in a row in superimposed relationship, the guide housing 9 can exhibit a uniform inside width which is somewhat larger than the case diameter.

A slide 23 is arranged on the underside of a bridge 26, the ends of the bridge being fixedly joined to respectively one of the guide strips 4. The slide 23 extends transversely to the barrel axis A and is located at the level of the uppermost cartridge 13 housed in the magazine box 8. The slide suitably exhibits a supporting strip 23*b* on its thrust face 23*a* facing the projectile 13*b*. It can be seen from FIG. 4 that the slide 23 is somewhat narrower than the inside width of the magazine box 8. In the zone of the magazine lips 18, the slide 23 is furthermore equipped with recesses 23*c*. The slide 23 also extends forwardly from the thrust face 23*a* approximately by the length of the magazine box 8 and is provided in this zone with a longitudinal slot 27, the hook 28 of the barrel mounting protruding through this slot. At the front, the slide 23 carries a buffer 29 of an elastic material. This buffer 29 constitutes a stop limiting the backward movement of the slide 23.

The mode of operation of the cartridge feeding device is as follows:

Once the breech mechanism is closed, the components assume the position illustrated in FIG. 1. Upon opening of the breech mechanism after operating the bolt handle, not shown, the breech mechanism can be pulled backwards. Since the mechanism is fixedly joined to the guide strips 4, these strips likewise move rearwardly with respect to the breech casing 1. The thrust face 23*a* of the slide 23 contacts the projectile tip 13*c* of the uppermost cartridge and pushes same out of the magazine box 8 in the rearward direction. During this process, the slide 23 moves through the upper zone of the magazine box and pushes the uppermost cartridge 13 into the guide housing 9. By the cartridge case 13*a* of the uppermost cartridge, the loading plate is urged downwardly against the force of the spring 16. The guide surface 14 is then located approximately in parallel to the barrel axis A and represents a bottom guide means for the cartridge case. Along the side, the cartridge case is guided by the sidewalls 12 of the guide housing 9. In the upward direction, the cartridge case initially cannot exit from the guide housing 9 since the longitudinal edges 12*a* exhibit a spacing b in the forward region of the opening 10 which spacing is smaller than the case diameter D. On account of the rearward taper of the guide housing 9, the cartridge 13 is moved toward the center between the guide strips 4. While the uppermost cartridge is pushed out of the magazine box, the remaining cartridges are urged upwards by the magazine spring 25, the cartridge case 13*a* of the presently uppermost cartridge coming into contact with the underside 23*d* of the slide. The buffer 29, finally, abuts against parts of the barrel mounting and thus limits the displacement motion of the slide 23 in the rearward direction. In this position, the thrust face 23 is located somewhat behind the breech head 3, as illustrated in FIG. 3. Since, at this point, only the projectile 13*b* and the case orifice are located in the forward half of the opening 10; whereas the case 13*a* is in the rearward half of the opening 10, the loading plate 14 can lift the cartridge under the effect of the spring 16. During this step, the projectile 13*b* and the case orifice pass between the longitudinal edges 12*a*. The loading plate 14 presses the cartridge case 12*a* upwardly against the holding lips 11. Since the mutually facing rims 11*a* of the lips exhibit at the front a larger space a than at the rear, the cartridge case 13*a* assumes the position illustrated in FIG. 3 wherein it is obliquely inclined upwards in the forward direction with respect to the barrel axis A and the projectile lip 13*c* lies approximately on the barrel axis A. The supporting strip 23*a* provided on the slide 23 has the task of supporting the projectile tip 13*c* to prevent the front end of the cartridge from tilting downwardly once the cartridge case 13*a* has left the magazine box. The elastic buffer 29 is to provide a soft abutment, on the one hand, and furthermore the slide 23, after having reached its rearwardmost position, is again moved forwardly to a slight extent by expansion of the elastic buffer 29 so that the projectile tip 13*c* is no longer in contact with the thrust face 23*a*. When the cartridge is in the loading position shown in FIG. 3, the breech mechanism can again be pushed forward, the bolt 5 coming into contact with the case bottom 13*d* and pushing the cartridge forward into the casing head 3 and finally into the cartridge chamber 2*a*. On account of the relatively long holding lips 11, the cartridge 12 is in all cases accurately aligned in the loading position and also is securely guided during insertion in the breech head.

When the slide 23 is in its rearward end position, it extends under the magazine lips 18 so that the magazine box cannot be removed. As soon as the last cartridge has been fired, no repeating action can be performed any longer for the slide 23 would then abut against the upwardly urged magazine bottom 24 and displacement toward the rear would thus be precluded.

What is claimed is:

1. A cartridge feeding device for a rifle, having a barrel, a breech casing, a magazine well provided therein, in front of a rearward end of the barrel underneath the rearward end for receiving a magazine box for holding a plurality of cartridges, said magazine box having a withdrawal opening in a rear wall thereof, two guide strips being mounted at the breech casing to be displaceable in the direction of the barrel axis and carrying a breech mechanism, and a loading plate pivotable about a pivot axis arranged transversely to the barrel axis below a moving zone of the breech mechanism, said loading plate comprising a supporting surface for a cartridge and being pivotable upward into a loading position under the effect of a spring, characterized in that a guide housing is arranged to the rear of the magazine well, said guide housing exhibiting, in a zone behind a breech head, an upper opening extending over one cartridge length and, in a rearward half of said opening, two mutually opposed holding lips in the manner of magazine lips, mutual spacing between said lips being smaller than a diameter D of a case of a cartridge; that the loading plate is mounted in the guide housing to be pivotable about a pivot axis provided at a front end of the housing and is arranged in the proximity of the magazine well; that the magazine box exhibits at the top an opening extending over an entire length of the box and, in a zone of the opening in the magazine box, two mutually opposed magazine lips; that a slide is provided in an upper zone of the magazine well, said slide being connected to the guide strips extending transversely to the barrel axis and being located at a level of an uppermost cartridge; said slide in a locking position of the breech mechanism, being disposed in front of a projectile tip of the uppermost cartridge, and coming into contact, during a backward movement of the breech mechanism with the projectile tip of the uppermost cartridge, pushing the cartridge rearwardly out of the magazine box into the guide housing.

2. A device according to claim 1, characterized in that the spacing between upper, mutually facing rims of the holding lips increases toward the front of the upper opening so that a cartridge urged against the holding lips by the loading plate is inclined obliquely upwardly in the forward direction with respect to the barrel axis and the projectile tip of the cartridge lies approximately on the barrel axis.

3. A device according to claim 2, characterized in that the upper opening of the guide housing exhibits in a forward half a width (b) smaller than the case diameter (D) but larger than the projectile diameter (d).

4. A device according to claim 3, characterized in that the slide is arranged on an underside of a bridge connecting the two guide strips, said slide having recesses for the magazine lips.

5. A device according to claim 2, characterized in that the magazine box, for a zigzag arrangement of the cartridges, has an inside width (w) somewhat smaller than twice the case diameter (D); that the guide housing has at a front end an inside width corresponding to that of the magazine box; and that the guide housing tapers toward a rear end to an inside width slightly larger than the case diameter (D).

6. A device according to claim 2, characterized in that the slide is arranged on an underside of a bridge connecting the two guide strips, said slide having recesses for the magazine lips.

7. A device according to claim 1, characterized in that the upper opening of the guide housing exhibits in a forward half a width (b) smaller than the case diameter (D) but larger than the projectile diameter (d).

8. A device according to claim 7, characterized in that the magazine box, for a zigzag arrangement of the cartridges, has an inside width (W) somewhat smaller than twice the case diameter (D); that the guide housing has at a front end an inside width corresponding to that of the magazine box; and that the guide housing tapers toward a rear end to an inside width slightly larger than the case diameter (D).

9. A device according to claim 7, characterized in that the slide is arranged on an underside of a bridge connecting the two guide strips, said slide having recesses for the magazine lips.

10. A device according to claim 1, characterized in that the magazine box, for a zigzag arrangement of the cartridges, has an inside width (w) somewhat smaller than twice the case diameter (D); that the guide housing has at a front end an inside width corresponding to that of the magazine box; and that the guide housing tapers toward a rear end to an inside width slightly larger than the case diameter (D).

11. A device according to claim 10, characterized in that the slide is arranged on an underside of a bridge connecting the two guide strips, said slide having recesses for the magazine lips.

12. A device according to claim 1, characterized in that the slide has a thrust face facing a projectile tip, a supporting strip on the thrust face extending under the projectile tip.

13. A device according to claim 1, characterized in that the slide is arranged on an underside of a bridge connecting the two guide strips, said slide having recesses for the magazine lips.

14. A device according to claim 1, characterized in that the slide has a portion that extends forwardly from a thrust face of the slide facing a projectile tip, approximately by a length of the magazine box.

15. A device according to claim 1, characterized in that backward movement of the slide is limited by a stop.

16. A device according to claim 15, characterized in that the stop is constituted by a buffer made of an elastic material.

* * * * *